United States Patent [19]

Holmes

[11] 4,096,845

[45] Jun. 27, 1978

[54] SYSTEM FOR REDUCING THE NUMBER OF CYLINDERS USED IN A MULTI-CYLINDER ENGINE

[76] Inventor: Charles F. Holmes, 804 E. Pembroke, Tuscola, Ill. 61953

[21] Appl. No.: 701,272

[22] Filed: Jun. 30, 1976

[51] Int. Cl.[2] ..... F02D 13/06

[52] U.S. Cl. ..... 123/198 F; 123/DIG. 1; 123/DIG. 7; 123/1 R

[58] Field of Search ..... 123/198 F, DIG. 7, DIG. 3, 123/DIG. 2, DIG. 1, 1 R

[56] References Cited

U.S. PATENT DOCUMENTS

| | | | |
|---|---|---|---|
| 1,275,752 | 8/1918 | Roberts | 123/198 F |
| 1,283,780 | 11/1918 | Huid | 123/198 F |
| 1,331,787 | 2/1920 | Schlatter | 123/198 F |
| 1,350,989 | 8/1920 | Cox | 123/198 F |
| 1,717,768 | 6/1929 | Fornaca | 123/198 F |
| 2,098,115 | 11/1937 | Voorhies | 123/198 F |
| 2,394,738 | 2/1946 | Anthony | 123/198 F X |
| 2,948,274 | 8/1960 | Wood | 123/198 F |
| 2,955,750 | 10/1960 | Phelp | 123/198 F |
| 3,874,358 | 4/1975 | Crower | 123/198 F |
| 3,945,367 | 3/1976 | Turner, Jr. | 123/198 F |

*Primary Examiner*—Charles J. Myhre

*Assistant Examiner*—Ira S. Lazarus

*Attorney, Agent, or Firm*—Sughrue, Rothwell, Mion, Zinn and Macpeak

[57] ABSTRACT

An apparatus and method are disclosed for converting a standard multi-cylinder internal combustion engine having a "split" intake manifold and "N" number of cylinders into a N/2 engine (as in converting a V-8 to V-4) to increase engine efficency and conserve fuel. One half of the split intake manifold is blocked off to prevent the fuel/air mixture from reaching one half of the engines' cylinders thereby preventing combustion within those cylinders. Horsepower losses due to compression of air within the deactivated cylinders are avoided by opening the intake valve passages and closing the exhaust valve passages. This forms a closed chamber between the deactivated cylinders and the intake manifold and allows the air to be pushed out of a cylinder during its normal compression stroke, through the intake manifold passages and into cylinders undergoing expansion strokes. The intake and exhaust valves may be retained in their respective positions by adjustment of the normal valve adjusting mechanism, or by providing devices which disconnect the valve train from the camshaft.

13 Claims, 14 Drawing Figures

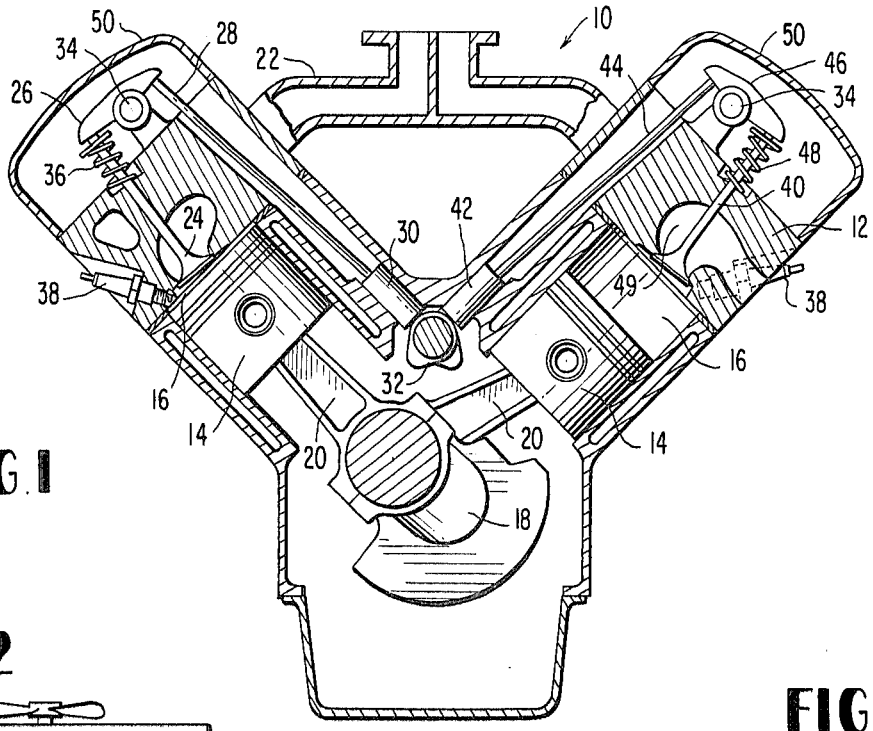
FIG. 1
FIG. 2
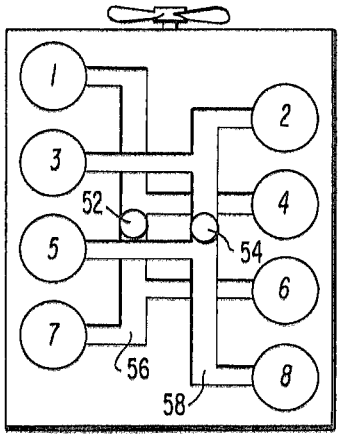
FIG. 3A
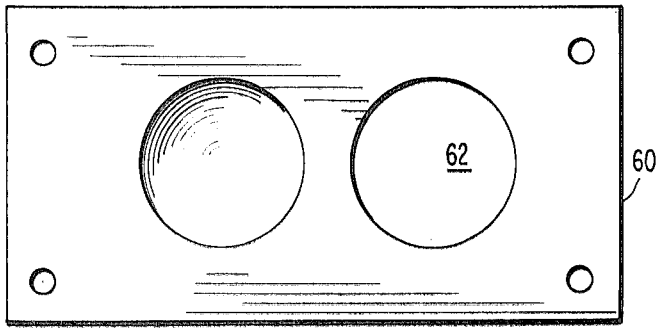
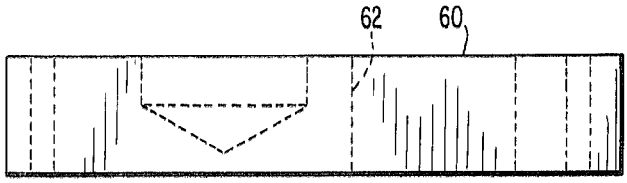
FIG. 3B
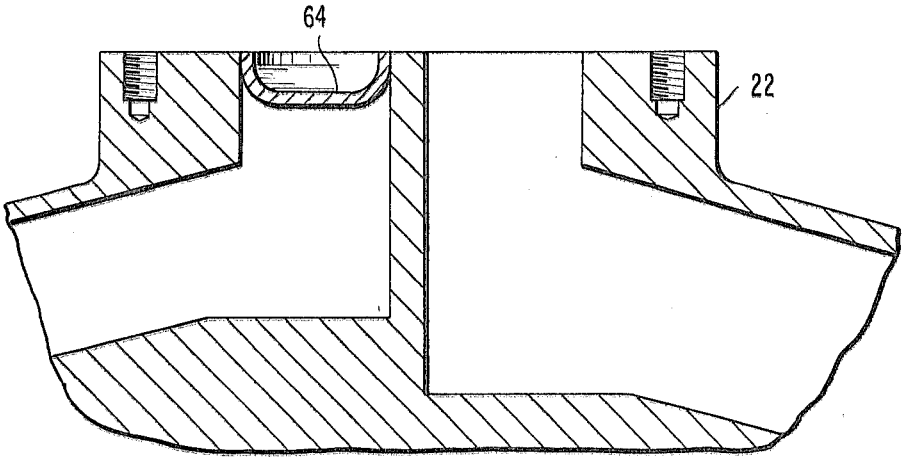
FIG. 4

FIG. 5A
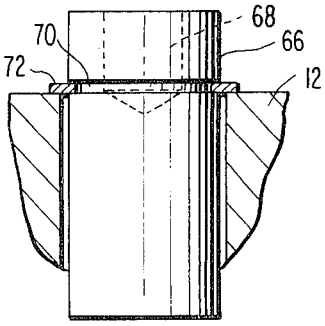
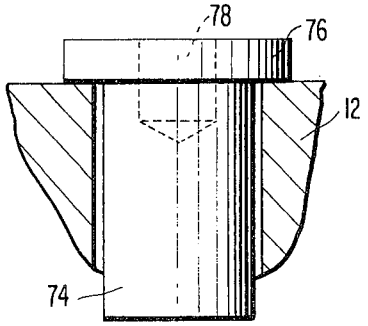
FIG. 5B
FIG. 5C
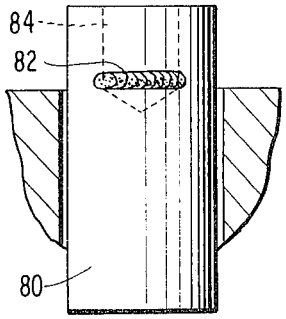
FIG. 6
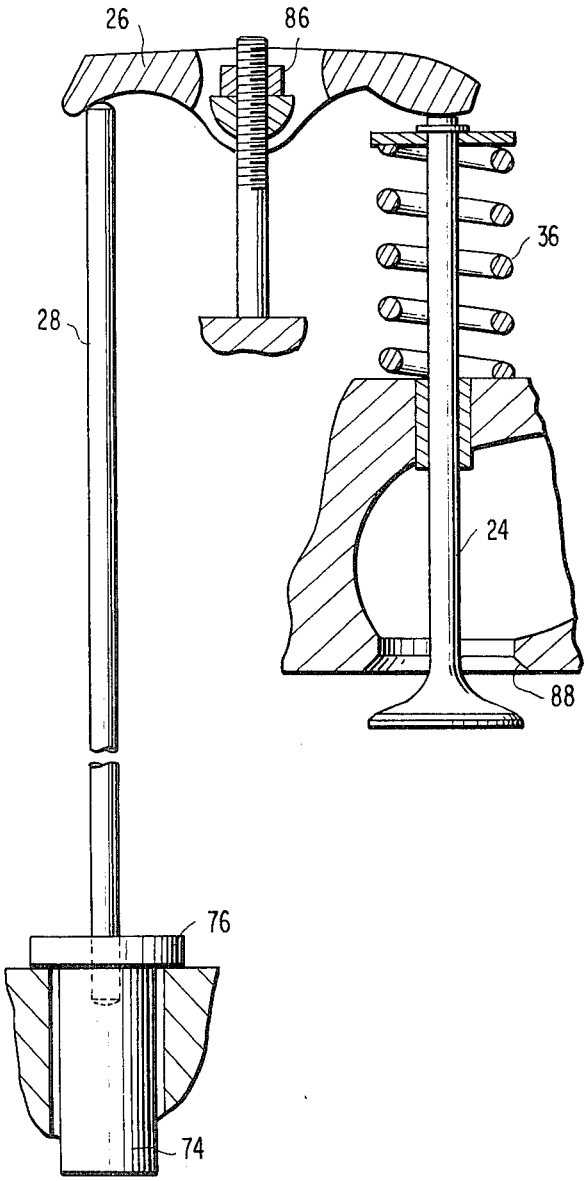
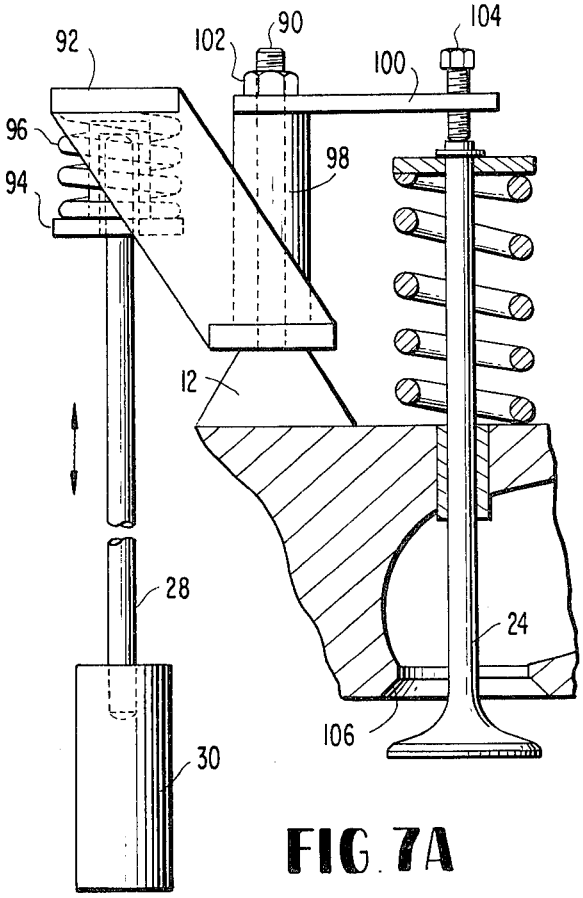
FIG. 7A
FIG. 7B
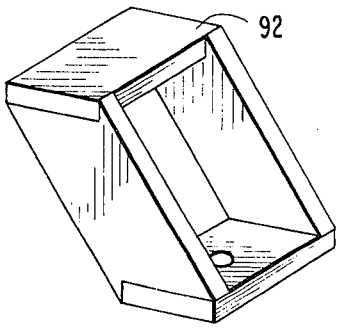

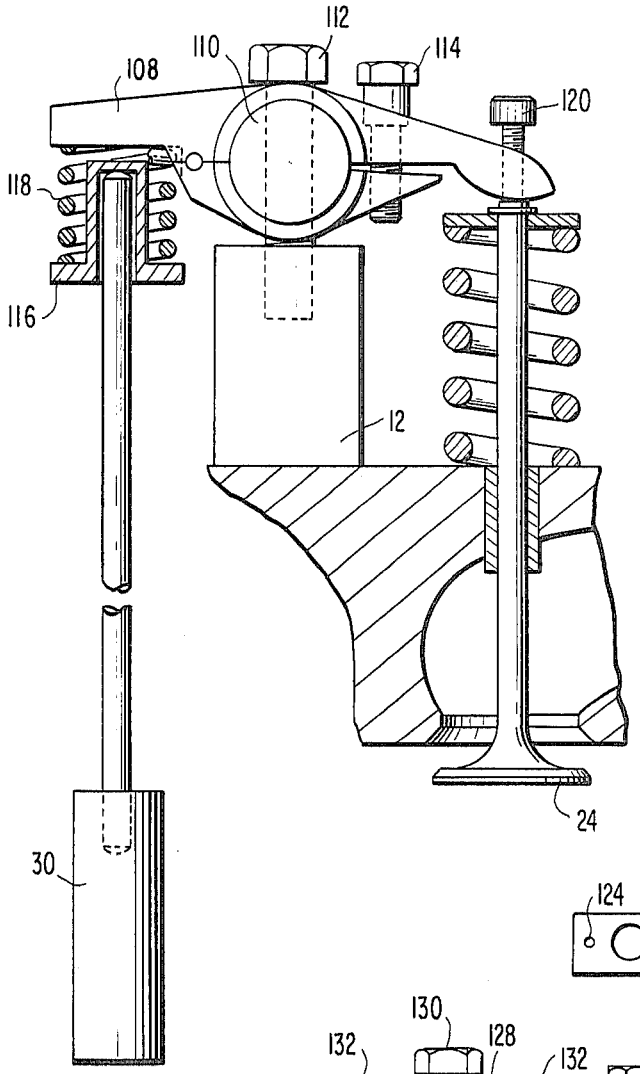
FIG. 8
FIG. 9
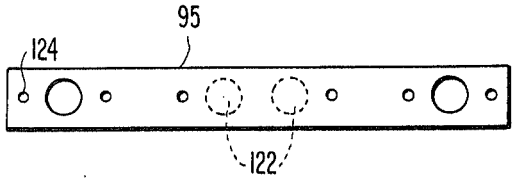
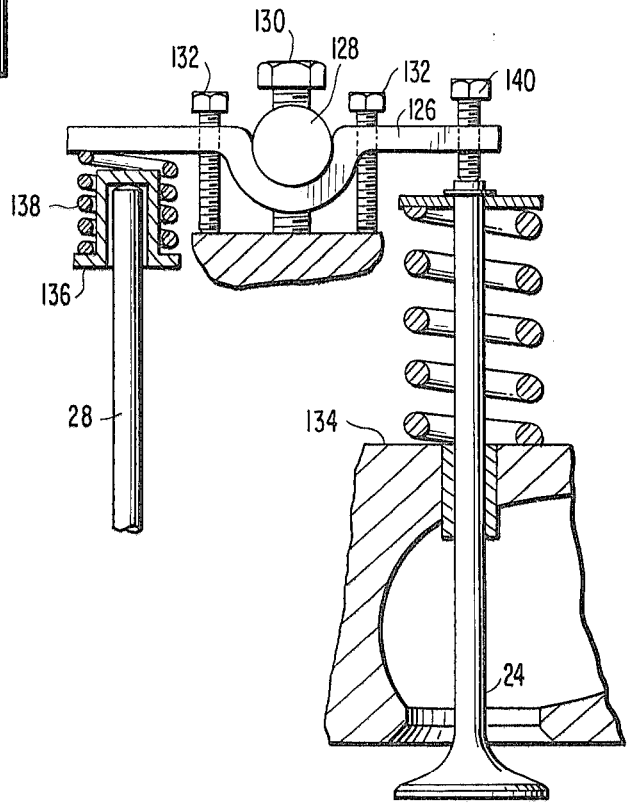
FIG. 10

SYSTEM FOR REDUCING THE NUMBER OF CYLINDERS USED IN A MULTI-CYLINDER ENGINE

BACKGROUND OF THE INVENTION

1. Field of the Invention

This invention relates to means for reducing the number of operational cylinders in a multi-cylinder internal combustion engine.

2. Description of the Prior Art

The broad concept of deactivating several cylinders of a multi-cylinder engine is well-known in the art as evidenced by the following U.S. patents:

U.S. Pat. No. 2,394,738 - Anthony;
U.S. Pat. No. 2,875,742 - Dolza;
U.S. Pat. No. 2,918,047 - Mick;
U.S. Pat. No. 2,947,298 - Dolza;
U.S. Pat. No. 2,948,274 - Wood;
U.S. Pat. No. 3,270,724 - Dolza;
U.S. Pat. No. 3,765,394 - Francis; U.S. Pat. No. 3,874,358 - Crower.

However, these prior art references have proven disadvantageous since they require major disassembly of the engine, do not completely eliminate horsepower losses due to air compression in the deactivated cylinders, are too complex to achieve a sufficiently high level of reliability or are designed such that they require a completely redesigned and remanufactured engine. Several of the prior art devices utilize means to deactivate one portion of a "split" intake manifold, but this is achieved by fully opening the throttle plate associated with the deactivated portion of the manifold and utilizing other means to cut off the fuel supply. Also, there is no showing of disengaging or modifying the valve train of the deactivated cylinders, wherein the intake valves or passages are opened and the exhaust valves, or passages are closed.

Several methods are known to prevent operation of the valve train such as inserting hydraulic pistons between the valve rocker arm and the valve lifter, or removal of the pushrod, but these are utilized to fix the intake valve in a closed position to prevent entry of the fuel/air mixture. Obviously, since the intake valves are closed, no means are provided to block off the intake manifold and it is impossible to use the intake manifold passage as part of the closed chamber which allows passage of the compression air from one cylinder to another.

SUMMARY OF THE INVENTION

The present invention is directed to a method and apparatus for converting a standard internal combustion engine having "N" number of cylinders into an engine having N/2 operational cylinders. Although the invention will be described with reference to converting a V-8 engine into a V-4 engine, it is to be understood that the principles embodied in the invention can be utilized with an engine having any number of cylinders. The structure of the V-8 is retained, but only four cylinders are capable of producing power while the remaining four cylinders are in a free running condition. The invention is particularly advantageous on V-8 engines utilizing a 180° style "split" intake manifold having at least two separate passages wherein one passage interconnects four cylinders with a manifold inlet orifice and a separate passage interconnects the remaining four cylinders to a second manifold inlet orifice. The conversion to a V-4 engine is achieved by blocking off one of the manifold passages, either by a plate inserted between the carburetor and the manifold, by plugging its inlet orifice or by modifying the carburetor such that the throttle remains closed thus preventing the fuel/air mixture from reaching the deactivated cylinders. The invention also utilizes the blocked off manifold passage connecting the deactivated cylinders as a closed chamber to eliminate horsepower losses caused by the compression of the air in these cylinders. The intake valve passages of the deactivated cylinders are maintained open thereby allowing the air to pass out of a deactivated cylinder undergoing a compression stroke, through the intake manifold passage, and into another deactivated cylinder wherein the piston is travelling downwardly. This allows the air to travel freely from one deactivated cylinder to another without compression. The exhaust valve passages are maintained closed to prevent entrance of exhaust gases into the deactivated cylinders by way of the exhaust manifold.

The intake and exhaust valve passages may be maintained in their respective conditions by opening and closing the intake and exhaust valves respectively by way of the standard valve adjusting mechanism, provided there is sufficient valve-to-piston clearance. The passages may also be opened and closed by isolating the valve train from the camshaft. The latter method may be carried out by substituting a dummy valve lifter for the normal lifter, the length of the dummy lifter being such that it does not contact the camshaft. Alternatively, a stationary structure may be substituted for the valve rocker arm while a spring is positioned between the pushrod and the structure such that no movement of the pushrod is transmitted to the valve which is rigidly attached to the stationary structure. In addition, or alternatively, to the closing of the exhaust valve, a plate may be interposed between the exhaust port through the engine block and the exhaust manifold to insure that no exhaust gases will leak into the deactivated cylinders.

The conversion of a V-8 engine into a V-4 engine enables the power producing cylinders to work at a higher level of efficiency producing more power for a given quantity of fuel. The amount of power produced per gallon of gasoline increases as engine efficiency increases which, in turn, increases fuel economy. However, it has been difficult to increase engine efficiency due to the fact that the large size of engines used today require more fuel to power a given sized vehicle since the engines themselves consume power merely to keep running. A good portion of the power consumed to keep the engine running is used in compressing the fuel/air mixture so that it can be ignited and produce power. If ignition were prevented in four cylinders of an eight cylinder engine, the power consumption would be just as large due to the compression of the fuel/air mixture in the deactivated cylinders.

It is an object of the present invention to minimize these compression horsepower losses and thereby increases engine efficiency by converting an engine having N cylinders into an engine having N/2 cylinders.

It is a further object to achieve such a conversion with a minimum of engine disassembly and allow reconversion to the original number of cylinders in the engine if desired.

It is a further object to increase the efficiency of an internal combustion engine by deactivating a portion of the power producing cylinders.

BRIEF DESCRIPTION OF THE DRAWINGS

FIG. 1 is a partial cross-section of a typical "V" engine.

FIG. 2 is a schematic diagram of a typical "split" intake manifold,

FIG. 3A is a top view of a typical plate inserted beneath the carburetor in the present invention.

FIG. 3B is a side view of the plate shown in FIG. 3A.

FIG. 4 is a partial, sectional view of an intake manifold with a plug inserted therein according to an alternative embodiment of the present invention.

FIG. 5A is a side view of a dummy valve lifter utilized with the invention.

FIG. 5B is a side view of a second embodiment of a dummy valve lifter utilized with the invention.

FIG. 5C is a side view of a third embodiment of a dummy valve lifter utilized with the invention.

FIG. 6 is a diagrammatic view of a valve actuating mechanism according to one embodiment of the invention.

FIG. 7A is a diagrammatic view of a valve mechanism according to a second embodiment of the invention.

FIG. 7B is a detailed perspective view of the stationary member shown in FIG. 7A.

FIG. 8 is a diagrammatic view of a valve mechanism according to a third embodiment of the invention.

FIG. 9 is a side view of a plate installed between the engine block and the exhaust manifold according to the invention.

FIG. 10 is an alternative embodiment of the stationary member shown in FIG. 7A.

DETAILED DESCRIPTION OF THE PREFERRED EMBODIMENT

A typical "V"-type internal combustion engine 10 is shown partially in cross-section in FIG. 1. This structure comprises an engine block 12 and pistons 14 reciprocating within cylinders 16. The pistons 14 are connected to crankshaft 18 by way of connecting rods 20. The air/fuel mixture is distributed to the cylinders 16 by way of a carburetor (not shown) attached to intake manifold 22. The air/fuel mixture enters the cylinders through the passage controlled by intake valves 24 which is, in turn, controlled by rocker arms 26 and push rods 28. The push rods 28 are connected to valve lifters 30 which bear against camshaft 32. Camshaft 32 is typically connected to the crankshaft 18 so as to rotate therewith, however, this mechanism is not shown for purposes of clarity. The cam surfaces of camshaft 32 bear against the internal ends of valve lifters 30 so as to push the pushrods 28 outwardly against the rocker arms 26, causing them to pivot about shaft 34 overcoming the force of valve springs 36 which normally biases the valves 24 in a closed position and, thereby opening the intake valves 24.

Ignition of the fuel/air mixture within the cylinder 16 is accomplished by way of spark plugs 38 supplied with electrical current by conventional means (not shown).

Exhaust valves 40 are also provided and are actuated by means similar to that of the intake valves. Namely, valve lifters 42 are pushed outwardly by cams on camshaft 32, thereby moving pushrods 44 against rocker arms 46 which pivot about shaft 34 and overcome the force of valve springs 48 to open the exhaust valves 40. The exhaust outlet passageway 49 is connected to an exhaust manifold (not shown) which directs exhaust gases to the outside of the vehicle.

It is understood that each cylinder has at least one intake valve and at least one exhaust valve, although only a single intake valve and a single exhaust valve are shown for illustrative purposes in FIG. 1. Valve covers 50 are usually provided to protect the valve actuating mechanism against dirt.

The explosive forces generated by the combustion of the fuel/air mixture forces one of the pistons 14 downwardly causing rotation of the crankshaft 18 by way of connecting rod 20. Crankshaft 18 is connected to a transmission device which transmits the rotary motion to the driving wheels of the vehicle.

The great majority of V-8 engines utilize 180° style "split" intake manifold. This type of intake manifold is shown diagrammatically in FIG. 2. The inlets to the manifold are shown at 52 and 54, each inlet being connected to at least one venturi of a multi-venturi carburetor. The diagram shows the engine cylinders numbered 1–8 and branch 58 of the split intake manifold connects inlet 52 with cylinders 1, 4, 6 and 7, while branch 56 of the manifold connects inlet 54 with cylinders 2, 3, 5 and 8. A usual firing order of such a V-8 engine is cylinders 1, 8, 4, 3, 6, 5, 7 and 2. Thus, the four cylinders connected by branch 58 are entirely independent of the four cylinders connected by branch 56.

In order to convert the standard V-8 engine as thus described, into a V-4 engine, it is necessary to block off the inlet of one of the intake manifold branches so as to prevent air/fuel mixture from being supplied to these cylinders. This may be accomplished by inserting plate 60, shown in FIGS. 3A and 3B, between the intake manifold inlet and the carburetor. Plate 60 has only one opening 62 therethrough which is aligned with one of the inlets of the intake manifold. The other inlet is blocked off so as to prevent the entrance of any fuel/air mixture into the cylinders connected to that branch of the intake manifold. The intake manifold shown is to be used with a two venturi carburetor. Obviously, when carburetors and manifold having more than two venturis are used, all of the inlets to one of the braches are blocked off by the plate, while all of the inlets to the other branch are left open.

Alternatively, a plug 64 may be placed in one of the inlets of the intake manifold 22, as shown in FIG. 4. This plug may be formed of any deformable material which has sufficient resistance to the vehicle fuel to prevent corrosion or other destruction of the plug upon usage.

Merely blocking off the fuel/air intake system leading to four of the engines' cylinders will not result in a V-4 engine which operates with optimum efficiency. Means must be provided to eliminate the horsepower losses caused by the compression of the air in the four inactive cylinders. This is accomplished by maintaining the intake valves in an open position throughout the operational cycle of the engine and at the same time maintaining the exhaust valves in each of the inactive cylinders closed throughout the cycle. Thus, instead of compressing the air within the deactivated cylinder, the air passes out through the intake valve during the compression stroke of each of these cylinders. Due to the location of the cylinders in the firing order, the air passes out of the cylinders undergoing compression, through the blocked off intake manifold and into the remaining deactivated cylinders in which the pistons are moving downwardly. Since the blocked off intake manifold passage and the deactivated cylinders form a continuous chamber of constant volume, the horsepower losses due to air compression are eliminated. The exhaust valves are maintained in a closed position to prevent the entrance of exhaust gases from the active cylinders into the inactive cylinders.

The engine valve train may be positioned in the aforementioned open and closed positions by any one of several means. The most expedient way to accomplish this is to adjust the intake and exhaust valves to their respective open and closed positions utilizing the adjustment mechanism of the valve train itself. Thus, the intake valves are adjusted so as to remain open throughout the cycle, while the exhaust valves are adjusted to remain closed or are allowed to operate while the passages through the engine block to the exhaust manifold are sealed. Although this is the simpliest way of accomplishing the desired result, in certain engine designs the amount of valve adjustment may be insufficient to prevent resultant air compression horsepower losses, or the valve-to-piston clearance may be insufficient to achieve sufficient adjustment.

If this is the case, the valve lifters associated with the valve train of the deactivated cylinders may be removed from the engine and replaced with dummy lifters. These dummy lifters are constructed such that they bear against one side of the valve lifter opening through the engine block and are of a length such that they do not contact the camshaft during any portion of its rotation. Use of the dummy lifters disconnects the valve train of the inactive cylinders from the camshaft and prevents any movement whatsoever. The dummy lifters may take one of the forms shown in FIGS. 5A, 5B and 5C. In FIG. 5A, the dummy lifter comprises a generally cylindrical body 66 having a diameter smaller than the opening for the valve lifters through the engine block 12 so as to slide easily into the opening. The dummy lifter 66 has an opening 68 in one end to receive one end of the valve pushrod, and a groove 70 is formed in the outer periphery of dummy lifter 66 so as to receive snap ring 72 therein. As can be seen from FIG. 5A, the snap ring 72 bears against the upper surface of the opening through the engine block 12 due to the force exerted thereon by the spring means of the valve train through the pushrod. The axial length of the lifter 66 is such that it does not contact the camshaft and, thereby completely isolates the valve train of the deactivated cylinders from the camshaft.

An alternative embodiment for the dummy valve lifter is shown in FIG. 5B. The dummy lifter 74 is maintained in position within the hole through the engine block 12 by way of integral flange 76. This integral flange 76 replaces the grooves and snap ring of the embodiment shown in FIG. 5A. The dummy lifter 74 has a hole 78 formed partially therethrough to engage one end of the valve pushrod. As in the first embodiment, the length of the dummy lifter is such that it does not contact the camshaft.

A third embodiment of the dummy valve lifter is shown in FIG. 5C. The lifter body 80 is generally cylindrical in shape and has at least one bead 82 welded to the outer surface. This embodiment may utilize the standard valve lifter body with the bead welded thereon such that the lifter does not contact the camshaft when placed into the engine block opening. The bead rests on the upper surface on the opening and prevents contact between the valve lifter and the camshaft. Opening 84 engages one end of the valve lifter pushrod as in the two previous embodiments.

The association of the dummy valve lifter with the engine valve train is shown in FIG. 6. Although the embodiment of the dummy lifter shown in FIG. 5B is illustrated in FIG. 6, it is to be understood that any of the previously described embodiments may be utilized. Using the dummy valve lifter 74 to maintain the valve pushrod 28 in a stationary postion, the intake valve 24 may be biased in the open position by turning the standard adjusting nut 86. Since the pushrod 28 cannot move downwardly, the rocker arm 26 is caused to pivot in a clockwise direction by the adjusting nut 86. This causes the intake valve 24 to remain open and does not permit it to contact the valve seat 88. Since the dummy valve lifter 74 does not contact the camshaft, the valve will remain motionless throughout the operational cycle of the engine.

In some engines, the adjusting nut 86 is replaced by a non-adjustable pivot, and adjusting means will be provided between the rocker arm 26 and the pushrod 28 or the pushrod and dummy valve lifter. This can also be utilized to cause the rocker arm 26 to pivot in a clockwise direction and maintain the valve 24 in an opened position since the pushrod 28 remains motionless during the operation of the engine. If no adjustment means are provided in the valve train, adjusting shims may be placed between the upper end of the pushrod 28 and the rocker arm 26 or between the valve stem or the rocker arm to achieve the opening of the intake valve. Similar methods may be utilized to maintain the exhaust valves for the deactivated cylinders in a closed position throughout the engines operation cycle.

In addition to maintaining the exhaust valves in their closed position, a plate may be installed between the exhaust manifold and the engine block to prevent the influx of exhaust gases into the deactivated cylinders. This plate is shown in FIG. 9 as element 95. The position of the blocked off exhaust ports are indicated in dotted lines at 122. Mounting holes 124 are located so as to fit the standard bolt pattern for connecting the exhaust manifold to the engine block.

Alternatively, the devices of FIGS. 7, 8 and 10 may be utilized if it is desired to leave the valve lifter and pushrod assemblies of the engine unmodified. In the case of engines having stud mounted rocker arms, the device of FIG. 7 may be interposed between the pushrod 28 and the valve 24 to prevent opening and closing of the valve. For this device to be utilized, it is necessary to completely remove the standard rocker arm from mounting stud 90. Member 92 is then placed on the valve mounting stud 90 as shown in FIG. 7A. Member 92, shown in FIG. 7B, may have a generally rectangular shape and may be fabricated by cutting a piece of rectangular tube at an angle. Obviously, other method of fabricating this device may be utilized. Spring retainer 94 is placed over the end of pushrod 28 and spring 96 is interposed between the spring retainer 94 and the member 92. Thus, it can be seen that as lifter 30 and pushrod 28 reciprocate due to the engagement of the lifter 30 with the camshaft, the motion will serve merely to compress spring 96 and will not be transmitted to the valve 24. Cylindrical spacer 98 is placed over stud 90 and valve attaching member 100 is retained in position on the stud 90 by nut 102. Screw 104 is threaded through valve retaining member 100 and onto the upper portion of the valve stem of valve 24. Screw 104 may then be adjusted to accurately and precisely adjust the opening of valve 24 with respect to valve seat 106.

In the case where the rocker arms are mounted on a rocker arm shaft, the apparatus of FIG. 8 may be utilized to disconnect the valves from the valve actuating mechanism. Member 108 is formed so as to clamp over the rocker arm shaft 110 which, in turn, is attached to the engine block by bolt 112. Bolt or screw 114 exerts a compression force on the bifurcated end of member 108 so as to cause a sufficient clamping force about rocker arm shaft 110. Spring retainer 116 is placed over the end of pushrod 28 and spring 118 is disposed between spring retainer 116 and member 108. Thus, as in the previously described embodiment, the reciprocating motion of valve lifter 30 and pushrod 28 is not transmitted to the valve, but merely causes compression of spring 118. The valve 24 is maintained in its required position by adjustment of screw 120 which is threadingly engaged with member 108 and presses against the upper portion of the valve stem of valve 24.

Another alternative structure for deactivating the valves is shown in FIG. 10. In this embodiment, arm 126 has a generally "U" shaped center section to fit around the standard rocker arm shaft 128, which is held in position by bolt 130. Bolts 132, are threaded through arm 126 and bear against the upper surface of the cylinder head 134 to force the arm 126 upwardly against the shaft 128 and to prevent any rocking motion of the arm about shaft 126. As is the previous embodiments, spring retainer 136 is fitted over the upper end of pushrod 28 and engages spring 138 between it and one end of arm 126. Valve 24 is attached to the opposite end of arm 126 by bolt 140 as in the embodiments shown in FIGS. 7 and 8. As can be seen, reciprocating movement of pushrod 28 merely compresses spring 138 without transmitting any movement to valve 24.

Although the embodiments of FIGS. 7, 8 and 10 were described in conjunction with the maintaining of the intake valves in an opened position, it is understood that similar devices may be utilized to maintain the exhaust valves of each deactivated cylinder in its closed position. This is achieved by adjusting the adjusting screws corresponding to those shown as 104, 120 and 140 in the aforedescribed embodiments such that the exhaust valves engage their corresponding seats.

Also, in addition to adjusting the exhaust valves closed, a plate may be inserted between the exhaust manifold and the exhaust port of the engine to positively insure that exhaust gases to not enter the deactivated cylinders.

While the foregoing steps and apparatus are sufficient to provide an engine having a reduced number of operating cylinders which will operate in a completely satisfactory manner further modifications may be made to the engine in order to improve mileage, performance or enable the engine to be easier to operate. These modifications are as follows:

(1) Modify or disconnect the vacuum advance to the distributor.

(2) Plug the accelerator pump discharge or discharges to deactivated cylinders on the manifold connection side of the carburetor.

(3) Limit the travel of or make a hole in the piston of the carburetor accelerator pump since the pump now only feeds a portion of the engine cylinders.

(4) Close the gap or possibly solder the gap shut on spark plugs in deactivated cylinders to prevent possible ignition of crank case vapors.

(5) Modify the ignition timing and/or advance curve of the distributor for more acceleration or increased mileage.

(6) Adjust the idle air bleed and/or idle speed on the active side or sides of a carburetor for improved idle, improved mileage or decreased emission.

(7) Change carburetor jets for more mileage, performance or decreased emissions.

(8) Change carburetor power valve for more mileage, performance or decreased emission. As a result of a substantial reduction of intake manifold vacuum due to deactivated cylinders.

(9) All spark plug wires should be left in the distributor cap and properly grounded to prevent arcing within the distributor cap to adjoining spark terminals.

(10) Under certain circumstances, i.e., fuel injection, it might be necessary to shut off the fuel supplied to the inactive cylinders.

(11) An additional tune-up modification may be to seal the carburetor to the manifold face since some of the carburetors have an equalizing passage.

It must be emphasized that the foregoing enumerated modifications are strictly optional or only required when dealing with specific engines and are therefore not necessary to provide an operative engine having a reduced number of operating cylinders according to the present invention.

In addition to the proposed methods of deactivation, two alternative methods could be employed. First, the respective lobes of the camshaft could be ground into a round configuration. Secondly, the intake valves of the deactivated cylinders could be removed entirely by plugging the valve guide. Although these modifications are not as desirable from an ease of installation viewpoint, on certain applications they may be the most advantageous method.

While the invention has been particularly shown and described with reference to preferred embodiments thereof, it will be understood by those in the art that the foregoing and other changes in form and details may be made therein without departing from the spirit and scope of the invention.

What is claimed is:

1. A conversion kit for deactivating half of the cylinders of a multi-cylinder reciprocating internal combustion engine of the type having an intake manifold to direct fuel/air mixture into said cylinders wherein said manifold has a first passage communicating with half of the cylinders and a separate, second passage communicating with the remaining cylinders, and having at least one intake valve opening and exhaust valve opening for each cylinder comprising:

(a) means to prevent fuel/air mixture from entering the first of said intake manifold passages, thereby deactivating all of the cylinders served by this passage;

(b) means to maintain each of the intake valve openings in those deactivated cylinders connected by said first intake manifold passage in an opened condition throughout the operational cycle of the engine such that the deactivated cylinders and the first intake manifold passage form a closed chamber; and (c) means to maintain each of the exhaust valve openings in those deactivated cylinders connected by said first intake manifold passage in a closed condition throughout the operational cycle of the engine.

2. The kit of claim 1 wherein the means to prevent the fuel/air mixture from entering the first of said intake manifold passages comprises a plate adapted to be attached to the manifold so as to cover the inlet of said first passage while leaving the inlet of said second intake manifold passage open.

3. The kit of claim 1 wherein the means to prevent the fuel/air mixture from entering the first of said intake manifold passages comprises a plug adapted to be inserted into the inlet of said first passage.

4. The kit of claim 1 for an engine having an intake valve and an exhaust valve disposed in each of said intake and exhaust valve openings respectively which are actuated by a rocker arm which is pivoted by engagement with a pushrod and valve lifter assembly caused to reciprocate by contact with a rotating camshaft, and wherein said means to maintain the intake valve openings is an opened condition and the exhaust valve opening in a closed condition comprises a valve lifter having means to retain said valve lifter in a stationary position within the engine such that it does not contact the camshaft.

5. The kit of claim 5 wherein the valve lifter has a slot in its outer periphery and the means to retain the valve lifter in a stationary position comprises a snap ring engaged in said slot formed in the outer periphery of said valve lifter, said snap ring extending radially beyond the periphery of the valve lifter so as to engage the engine block and prevent axial movement of the valve lifter toward the camshaft.

6. The kit of claim 5 wherein the means to retain the valve lifter in a stationary position comprises a flange formed on one end of said valve lifter, said flange having a diameter greater than the diameter of the valve lifter so as to engage the engine block and prevent axial movement of the valve lifter toward the camshaft.

7. The kit of claim 5 wherein the means to retain the valve lifter in a stationary position comprises a bead welded onto the outer periphery of the valve lifter and extending radially outwardly of said periphery so as to engage the engine block and prevent axial movement of the valve lifter toward the camshaft.

8. The kit of claim 1 for an engine having an intake valve and an exhaust valve disposed in each of said intake and exhaust valve openings respectively which are actuated by a reciprocating pushrod, and wherein said means to maintain the intake valve openings in an opened position and the exhaust valve openings in a closed position comprises:

(a) a stationary structure adapted to be attached to the engine, said structure having first and second arms;
(b) means to adjustably attach the valve to said first arm such that the position of the valve is manually adjustable; and
(c) spring means interposed between said second arm and said pushrod to allow said pushrod to reciprocate without transmitting motion to said valve.

9. A method of deactivating half of the cylinders of a multi-cylinder internal combustion engine comprising the steps of:

(a) blocking the flow of fuel/air mixture to one half of the cylinders so as to deactivate these cylinders;
(b) maintaining the intake valve openings of the deactivated cylinders in an open condition throughout the operational cycle of the engine; and
(c) maintaining the exhaust valve openings of the deactivated cylinders in a closed condition throughout the operational cycle of the engine.

10. A reciprocating internal combustion engine comprising:

(a) an engine block having N number of cylinders, each cylinder having at least one intake valve opening and at least one exhaust valve opening;
(b) a piston reciprocating in each cylinder;
(c) a power output crankshaft rotatably attached to the block;
(d) connecting rods connecting each piston to the crankshaft such that reciprocating movement of the pistons causes said crankshaft to rotate;
(e) mixing means to mix fuel with air;
(f) an intake manifold connecting the mixing means to each of the intake valve openings to direct the fuel/air mixture into the cylinders, said manifold having at least a first passage communicating with N/2 number of cylinders and at least a second passage communicating with N/2 number of cylinders;
(g) means to detonate the fuel/air mixture in the cylinders to cause the pistons to reciprocate;
(h) means to prevent fuel/air mixture from entering the first of said intake manifold passages, thereby deactivating all of the cylinders severed by this passage;
(i) means to maintain each of the intake valve openings in those deactivated cylinders connected by said first intake manifold passage in an opened condition throughout the operational cycle of the engine such that the deactivated cylinders and the first intake manifold passage form a closed chamber; and
(j) means to maintain each of the exhaust valve openings in those deactivated cylinders connected by said first intake manifold passage in a closed condition throughout the operational cycle of the engine.

11. An engine as set forth in claim 10 wherein said engine has a V-8configuration.

12. An engine as set forth in claim 11 wherein said V-8 engine has a split intake manifold defining said first and second passages.

13. An engine as set forth in claim 12 wherein the first intake manifold passage is connected to cylinders 1, 4, 6, 7, said second intake manifold passage is connected to cylinders 8, 3, 5 and 2 and the firing order of said cylinders is 1, 8, 4, 3, 6, 5, 7, 2.

* * * * *